US007868686B2

(12) United States Patent
Uehara

(10) Patent No.: US 7,868,686 B2
(45) Date of Patent: Jan. 11, 2011

(54) BAND GAP CIRCUIT

(75) Inventor: Osamu Uehara, Chiba (JP)

(73) Assignee: Seiko Instruments Inc., Chiba-shi, Chiba (JP)

( * ) Notice: Subject to any disclaimer, the term of this patent is extended or adjusted under 35 U.S.C. 154(b) by 876 days.

(21) Appl. No.: 11/655,301

(22) Filed: Jan. 19, 2007

(65) Prior Publication Data

US 2007/0181952 A1 Aug. 9, 2007

(30) Foreign Application Priority Data

Jan. 20, 2006 (JP) ..... 2006-012856

(51) Int. Cl.
*G05F 1/10* (2006.01)

(52) U.S. Cl. ..... 327/539; 327/143

(58) Field of Classification Search ..... 327/539–541; 323/313–316

See application file for complete search history.

(56) References Cited

U.S. PATENT DOCUMENTS 5,568,045 A * 10/1996 Koazechi ..... 323/314
5,949,277 A * 9/1999 Iravani ..... 327/541
6,535,054 B1 * 3/2003 Ceekala et al. ..... 327/539
6,864,741 B2 * 3/2005 Marsh et al. ..... 327/539
7,113,025 B2 * 9/2006 Washburn ..... 327/539
7,167,027 B2 * 1/2007 Matsuo et al. ..... 327/57
7,288,925 B2 * 10/2007 Nagata ..... 323/313
7,514,988 B2 * 4/2009 Uehara ..... 327/539
2004/0051581 A1 3/2004 Abe
2006/0071703 A1 * 4/2006 Chatterjee et al. ..... 327/534

FOREIGN PATENT DOCUMENTS

JP 2004-86750 3/2004

* cited by examiner

*Primary Examiner*—Hai L Nguyen
(74) *Attorney, Agent, or Firm*—Brinks Hofer Gilson & Lione

(57) ABSTRACT

Provided is a band gap constant-voltage circuit which is configured by combining a PMOS transistor, an NMOS transistor, a bipolar transistor, and a resistor, and is capable of preventing an output voltage from being stabilized at 0 V immediately after power supply fluctuation. According to the band gap constant-voltage circuit of the present invention, the back-gates of two p-type transistors (P112 and P 113) constituting a differential amplifier are each connected to a node (11) which is a power source terminal on the positive side of the differential amplifier, and a level shifter circuit is connected to the gate of each of the transistors (P112 and P113).

3 Claims, 2 Drawing Sheets

PRIOR ART

BAND GAP CIRCUIT

This application claims priority under 35 U.S.C. § 119 to Japanese Patent Application No. JP2006-012856 filed Jan. 20, 2006, the entire content of which is hereby incorporated by reference.

BACKGROUND OF THE INVENTION

1. Field of the Invention

The present invention relates to a circuit configuration of a band gap circuit, in particular, a band gap circuit capable of outputting an output voltage without changing a K-value even in a case of using a transistor which is large in size and has poor response characteristics with a small K-value.

2. Description of the Related Art

FIG. 2 is a circuit diagram of a conventional band gap reference voltage circuit. The voltage circuit is constituted of PMOS transistors P21, P22, P23, P24, and P25, NMOS transistors NL21, NL22, and NL23, an n-channel type depression transistor ND21, bipolar transistors B21 and B22, and resistors R21, R22, and R23. In FIG. 2, when a ratio of an area of an emitter of a first bipolar transistor B21 to that of a second bipolar transistor B22 is set to 1:N, an output voltage VREF expressed by the equation $$VREF=VBE+Vt\times 1n\ N(1+R21/R22)$$

can be obtained under normal conditions. In the equation, VBE is a voltage applied across the base and the emitter of a bipolar transistor, and Vt is obtained by the equation of Vt=kT/q, where k is a Boltzmann constant, T is an absolute temperature, and q is an electron charge.

(Patent Document 1) JP 2004-86750 A

The conventional example of FIG. 2 is configured so as to be capable of outputting a predetermined output voltage VREF from an output terminal under stable conditions when a power supply voltage is applied across a power supply terminal VDD of a high potential and a power supply terminal VSS of a low potential. However, there is a drawback in the conventional example in that, in the case where sizes of the transistors P24 and P25 have been increased (to, for example, 100 μm for width "W" and 50 μm for length "L") for offset elimination, if the transistor is the one manufactured by a process which leads to poor response characteristics in which a K-value is further decreased, the output voltage is stabilized at 0 V immediately after the power supply fluctuation.

SUMMARY OF THE INVENTION

It is an object of the present invention to provide a band gap constant-voltage circuit which is configured by combining a PMOS transistor, an NMOS transistor, a bipolar transistor, and a resistor, and is capable of preventing an output voltage from being stabilized at 0 V immediately after the power supply fluctuation.

According to the constant-voltage circuit of the present invention, in order to solve the above-mentioned problem, a reference power supply circuit of the present invention adopts the following means as shown in FIG. 1.

(1) A reference power supply circuit is characterized in that the back-gates of transistors P112 and P113 are each connected to a node 11.

(2) A reference power supply circuit is characterized in that a level shifter circuit is connected to the gate of each of the transistors P112 and P113.

In this manner, according to the reference power supply circuit of the present invention, it is possible prevent an output voltage from being stabilized at 0 V immediately after the power supply fluctuation without changing the K-value for a transistor even when the transistor which is large in size and manufactured by a process that leads to poor response characteristics with a small K-value, is used.

DETAILED DESCRIPTION OF THE PREFERRED EMBODIMENTS

Figure 1:
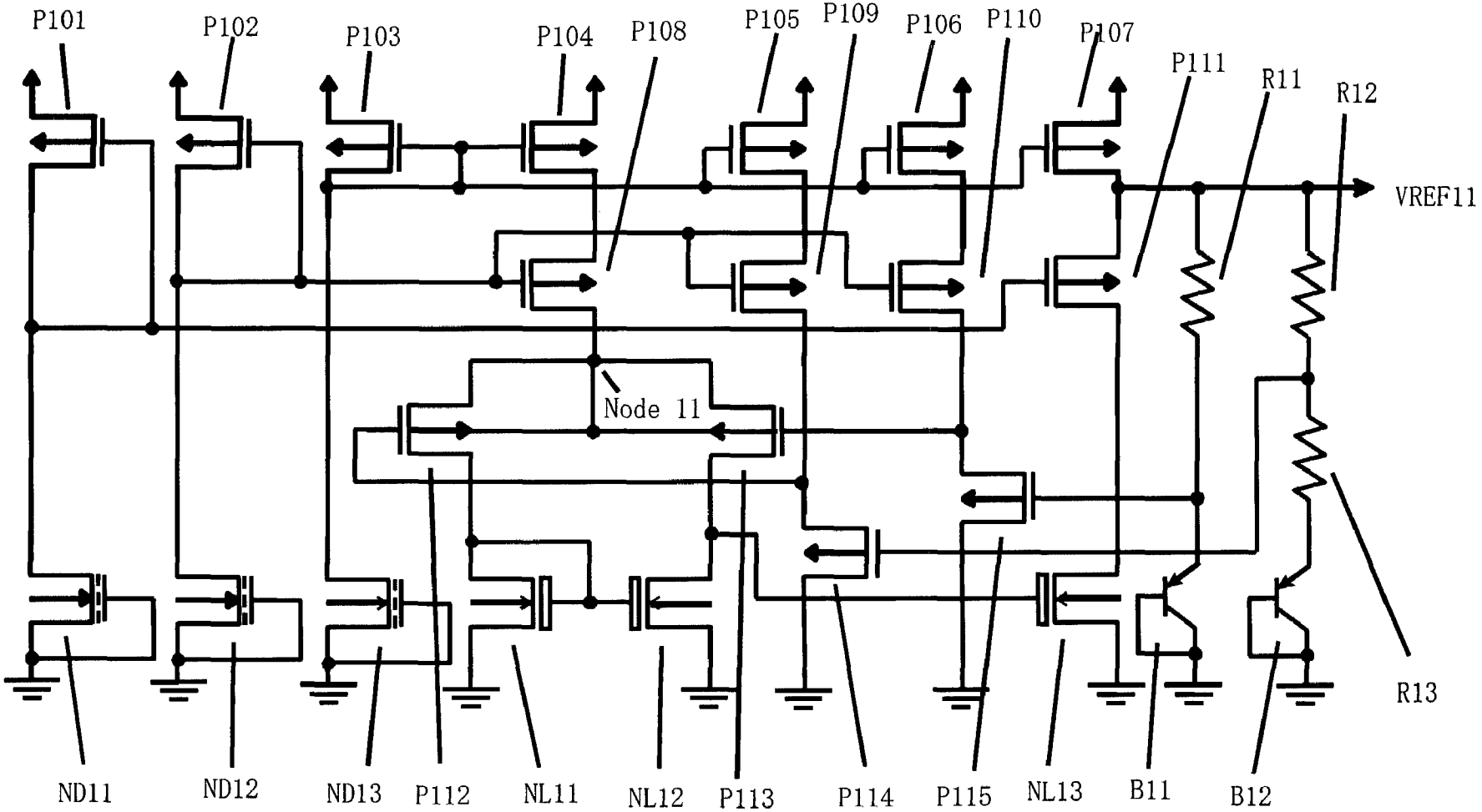
FIG. 1 is a circuit diagram showing a band gap reference voltage circuit according to an embodiment of the present invention.

Hereinafter, an embodiment of the present invention is explained. FIG. 1 is a circuit diagram showing a band gap circuit according to an embodiment of the present invention.

Firstly, a configuration of the band gap circuit is explained. As shown in FIG. 1, the band gap circuit includes a differential amplifier, an n-channel type transistor NL13 connected to the differential amplifier, level shifter circuits connected to an input of the differential amplifier, and a p-channel type transistor P108 which is a cascode transistor provided between the differential amplifier and a p-channel type transistor P104. Note that, hereinafter the n-channel type transistor is abbreviated as n-type transistor, and the p-channel type transistor is abbreviated as p-type transistor.

The differential amplifier is formed of a general operational amplifier. As shown in FIG. 1, the differential amplifier of the band gap circuit is constituted of a pair of p-type transistors P112 and P113 and n-type transistors NL11 and NL12, the n-type transistors having a low threshold voltage in the range of 0.4 to 0.5V (for example, 0.45 V).

The source of the n-type transistor NL11 is connected to a ground, which serves as a reference potential, while the drain thereof is connected to the drain of the p-type transistor P112. Also, the gate of the n-type transistor NL11 is connected to the gate of the n-type transistor NL12. Further, the drain and the gate of the n-type transistor N11 are connected to each other (diode connection). The source of the n-type transistor NL12 is connected to a ground, while the drain thereof is connected to the drain of the p-type transistor 113, as in the case of the n-type transistor NL11. Also, the gate of the n-type transistor NL12 is connected to the gate of the n-type transistor NL11.

The drain of the p-type transistor P112 is connected to the drain of the n-type transistor NL11, and the source of the p-type transistor P112 is connected to a power supply voltage VCC through the p-type transistor P108 and P104. Also, the back-gate of the p-type transistor P112 is connected to a node 11. Further, the gate of the p-type transistor P112 is connected to the source of a p-type transistor P114. The drain of the p-type transistor P113 is connected to the drain of the n-type transistor NL12, while the source thereof is connected to the power supply voltage VCC through the p-type transistors P108 and P104, as in the case of the p-type transistor P112. Also, the back-gate of the p-type transistor P113 is connected to the node 11. Further, the gate of the p-type transistor P113 is connected to the source of a p-type transistor P115.

The n-type transistor NL13 having a low threshold voltage in the range of 0.4 to 0.5V (for example, 0.45 V) is connected to the differential amplifier, and is also connected to an output terminal VREF 11 through a p-type transistor P111. The gate of the n-type transistor NL13 is connected between the n-type transistor NL12 and the p-type transistor P113 both constituting the differential amplifier, with the gate of the n-type transistor NL13 being connected to the drain of each of the n-type transistor NL12 and the p-type transistor P113.

A p-type transistor P107 is connected to the output terminal VREF 11. The drain of the p-type transistor P107 is connected to the output terminal VREF 11, while the source of the p-type transistor P107 is connected to the power supply voltage VCC. The gate of the p-type transistor P107 is connected to the gate of the p-type transistor P104, and is also connected to the gate of the p-type transistor P103 which is used as a constant current source. The p-type transistor P107 is supplied with a current at the gate from the constant current source to turn on and off the gate. In response to this, the p-type transistor P107 supplies the output terminal VREF 11 with a current from the power supply voltage VCC.

The p-type transistor P104 is connected to the p-type transistor P103 which is used as a constant current source. The drain of the p-type transistor P104 is connected to the differential amplifier circuit through the p-type transistor P108, while the source thereof is connected to the power supply voltage VCC. Further, the gate of the p-type transistor P104 is connected to the gate of each of the p-type transistors P107, P106, and P105. At the same time, the gate of the p-type transistor P104 is also connected to the gate of the p-type transistor P103 which is used as a constant current source. The p-type transistor P104 is supplied with a current at the gate from the constant current source, to thereby turn on and off the gate. In response to this, the p-type transistor P104 supplies the differential amplifier with a current from the power supply voltage VCC. Also, the p-type transistor P103, the p-type transistor P104, the p-type transistor P105, p-type transistor P106, and the p-type transistor P107, which are used as constant current power sources, constitute a current mirror circuit.

The p-type transistor P104 is connected to the differential amplifier through the p-type transistor P108 connected in cascode. In this manner, it is possible to prevent a channel length from being modulated, to thereby supply the differential amplifier with a stable current. Similarly, the p-type transistor P105 is connected in cascode with the p-type transistor P109. The p-type transistor P107 is connected in cascode with the p-type transistor P111.

The p-type transistor P103 and an n-type depression transistor ND13 are connected to each other through the drains thereof, and used as a constant voltage source. The n-type depression transistor ND13 used as a direct-current power source has the source and the gate connected to a ground, and has the drain connected to the drain of the p-type transistor P103. The source of the p-type transistor P103 is connected to the power supply voltage VCC, while the drain thereof is connected to the drain of the n-type depression transistor ND13. The p-type transistor P103 has the drain and the gate connected to each other (diode connection), and the gate thereof is connected to the gate of each of the p-type transistor P104, p-type transistor P105, p-type transistor P106, and the p-type transistor P107. Similarly, a p-type transistor P102 and an n-type depression transistor ND12 are also used as a constant voltage source, and the gate of the p-type transistor P102 is connected to the gate of each of the p-type transistor P108, p-type transistor P109, and p-type transistor P110. A p-type transistor P101 and an n-type depression transistor ND11 are also used as a constant voltage source, and the gate of the p-type transistor P101 is connected to the gate of the p-type transistor P111.

The p-type transistor P114 used as a level shifter circuit has the drain connected to a ground. The source of the p-type transistor P114 is connected to the power supply voltage VCC through the gate of the p-type transistor 112, the p-type transistor P109, and the p-type transistor P105. Also, the gate of the p-type transistor P114 is connected to the output terminal VREF 11 through a resistor R12. Similarly, the p-type transistor P115 used as a level shifter circuit has the drain connected to a ground, while the source thereof is connected to the power supply voltage VCC through the gate of the p-type transistor P113, the p-type transistor P110, and the p-type transistor P106. Also, the gate of the p-type transistor P115 is connected to the output terminal VREF 11 through a resistor R11.

Connected between the output terminal VREF 11 and a ground are the resistor R12, the resistor R13, and a bipolar transistor B12 in this order from the output terminal VREF 11 side. In addition, connected between the output terminal VREF 11 and a ground are the resistor R11 and a bipolar transistor B11 in this order from the output terminal VREF 11 side.

The bipolar transistor B12 has a base and a collector both connected to a ground, while an emitter thereof is connected to a resistor R13. The resistor R13 is connected to the bipolar transistor B12 at one end, while connected to the resistor 12 and to the gate of the p-type transistor P114 at the other end. The resistor R12 is connected to the resistor R13 and to the gate of the p-type transistor P114 at one end, while connected to the output terminal VREF 11 at the other end.

The bipolar transistor B11 has a base and a collector both connected to a ground, while has an emitter connected to the resistor R11 and to the gate of the p-type transistor P115. Also, the resistor R11 is connected to the bipolar transistor B12 at one end, while connected to the output terminal VREF 11 at the other end.

Figure 2:
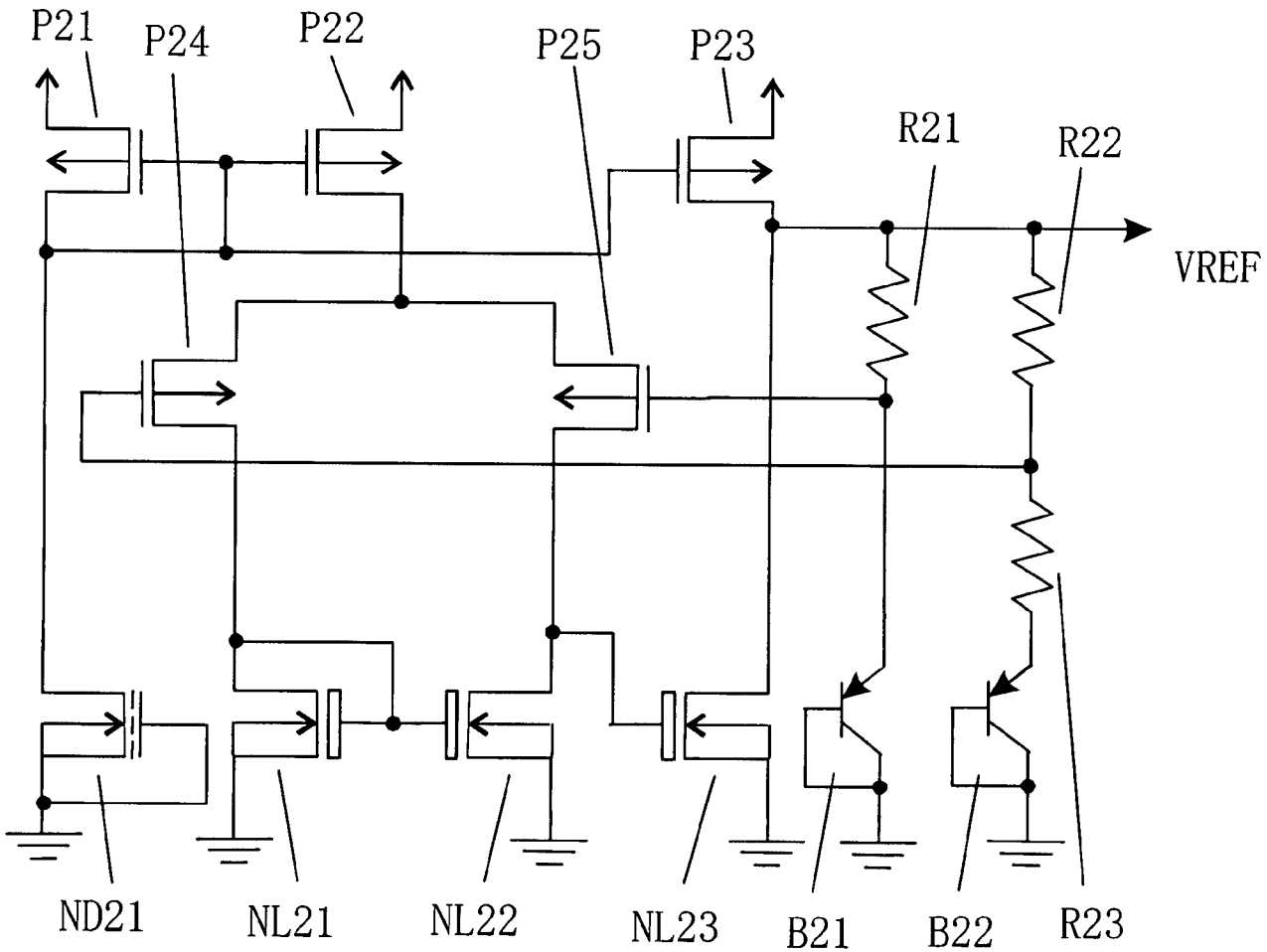
FIG. 2 is a circuit diagram showing a conventional band gap reference voltage circuit.

Next, with reference to FIGS. 1 and 2, an operation of the band gap circuit is explained by comparison with the operation of the conventional band gap circuit. Unless a transient voltage fluctuation occurs, an input voltage to the differential amplifier remains invariant and a constant voltage is outputted from the VREF 11. In contrast, when a transient voltage fluctuation occurs due to a power supply fluctuation (for example, the voltage is increased from 6 V to 30 V), the conventional circuit shown in FIG. 2 is greatly affected by the power supply voltage fluctuation because the back-gates of the p-type transistors P24 and P25 are connected to the VCC. When those transistors are increased in size (to, for example, 100 μm in W length and 50 μm in L length), or when a transistor manufactured by a process which leads to poor response characteristics with a decreased K-value is used as each of the P-type transistors P24 and P25 for offset elimination, there occur instantaneous interruptions due to a change in a voltage applied to the back-gates when the power supply voltage fluctuation occurs. During the interruptions, an excessive current flows through the emitters of the bipolar transistors B21 and B22, and an output voltage stabilized at a voltage (of, for example, 0 V), which is not a voltage originally intended for stabilization, is outputted to the VREF terminal.

On the other hand, according to this embodiment as shown in FIG. 1, the back-gates of the p-type transistors P112 and P113 are connected to the node 11, and therefore the back-gates are not affected from the power supply voltage fluctuation. Therefore, there occurs no instantaneous interruptions and no excessive current flows through the bipolar transistor B11 even when a transient power supply voltage fluctuation occurs, to thereby make it possible to output a constant voltage as originally intended.

In a case where the back-gates of the p-type transistors P24 and P25 of FIG. 2 are connected to the node 11, the threshold values for the p-type transistors P24 and P25 increase, which means that a higher voltage than those in the conventional cases is required to turn on the transistors. Accordingly, there occurs a phenomenon in which the p-type transistors P24 and P25 are not turned on even when the power is turned on, with the result that the voltage applied to the VREF terminal continues to rise. In view of this, according to this embodiment as shown in FIG. 1, the gates of the p-type transistors P112 and P113 are connected to the drain of the p-type transistor P114 or of the p-type transistor P115, the p-type transistors P114 and P115 each being used as a level shifter circuit, and the gate voltage of the p-type transistors P112 and P113 is increased, thereby making it possible to turn on the p-type transistors P112 and P113 with a conventional voltage. A modification is made as described above, to thereby make it possible to output a constant output voltage at the time of a power supply fluctuation and a turn-on of the power source.

What is claimed is:

1. A band gap circuit having a differential amplifier circuit, comprising:

a pair of PMOS transistors; and a level shifter circuit, wherein:

the pair of PMOS transistors are connected to each other through source terminals thereof;

the level shifter circuit is connected to a gate of each of the pair of PMOS transistors, the gate being used as an input terminal; and the pair of PMOS transistors each have a back-gate connected to each of the source terminals, the band gap circuit further comprising:

a PMOS transistor for supplying the differential amplifier with a constant current; and another PMOS transistor for constituting another level shifter circuit, wherein the PMOS transistors are connected to each other in cascode.

2. The band gap circuit according to claim 1, wherein the pair of PMOS transistors are large in size as compared with other PMOS transistors in the band gap circuit.

3. The band gap circuit according to claim 1, wherein the differential amplifier circuit is formed of a PMOS transistor and an NMOS transistor, the NMOS transistor having a threshold voltage in a range of 0.4 to 0.5 V.

* * * * *